US006960873B2

(12) United States Patent
Patel

(10) Patent No.: US 6,960,873 B2
(45) Date of Patent: Nov. 1, 2005

(54) CRT HAVING INTERNAL NEUTRAL DENSITY FILTER FIELD OF USE

(75) Inventor: Himanshu Mukundray Patel, Escondido, CA (US)

(73) Assignee: Thomson Licensing, Boulogne-Billancourt (FR)

( * ) Notice: Subject to any disclaimer, the term of this patent is extended or adjusted under 35 U.S.C. 154(b) by 76 days.

(21) Appl. No.: 10/223,571

(22) Filed: Aug. 19, 2002

(65) Prior Publication Data

US 2004/0032199 A1 Feb. 19, 2004

(51) Int. Cl.[7] ..... H01J 29/10

(52) U.S. Cl. ..... 313/461; 313/473; 313/477 R; 313/474; 313/112

(58) Field of Search ..... 313/461, 463, 313/473, 477 R, 480, 112, 474

(56) References Cited

U.S. PATENT DOCUMENTS

| | | | | |
|---|---|---|---|---|
| 2,676,109 A | | 4/1954 | Barnes et al. | 501/61 |
| 2,959,483 A | * | 11/1960 | Kaplan | 430/27 |
| 3,504,212 A | | 3/1970 | Wollentin et al. | 313/474 |
| 3,532,919 A | | 10/1970 | Fujimoto | 313/474 |
| 3,946,267 A | * | 3/1976 | Lustig et al. | 313/473 |
| 4,135,112 A | * | 1/1979 | Fisher et al. | 313/470 |
| 4,245,242 A | * | 1/1981 | Trcka | 348/816 |
| 4,392,077 A | * | 7/1983 | Libman | 313/474 |
| 5,121,030 A | * | 6/1992 | Schott | 313/474 |
| 5,627,429 A | | 5/1997 | Iwasaki | 313/474 |
| 5,760,540 A | * | 6/1998 | Duistermaat | 313/477 R |

* cited by examiner

*Primary Examiner*—Joseph Williams
*Assistant Examiner*—Kevin Quarterman
(74) *Attorney, Agent, or Firm*—Joseph S. Tripoli; Harvey D. Fried; Richard LaPeruta, Jr.

(57) ABSTRACT

A novel CRT and method of making the CRT are disclosed. The CRT comprises an internal neutral density filter that lies between the phosphor deposits and the interior surface of the faceplate panel. The filter enhances the contrast of the CRT without compromising center to edge brightness ratio of the CRT. The filter comprises very fine particles, wherein the particles are black, gray, or a mixture of black and gray. The filter reduces the absorption of the faceplate by 25 to 75%. The invention is particularly useful for substantially flat CRTs. The method of producing the novel CRT comprises the steps of preparing a suspension of well-dispersed light-absorbing, carbon-containing particles which are 0.05 to 2 microns in aqueous media and applying the suspension onto the interior surface of the faceplate panel prior to applying at least one phosphor deposit. The suspension may also include suitable organic and inorganic binders and dispersing and wetting agents.

4 Claims, 2 Drawing Sheets

CRT HAVING INTERNAL NEUTRAL DENSITY FILTER FIELD OF USE

This invention relates a CRT having an internal neutral density filter on a faceplate panel and method of making the CRT. The internal neutral density filter acts to enhance the contrast of the CRT and reduce the transmission of the faceplate.

BACKGROUND OF THE INVENTION

To enhance the contrast and improve the brightness ratio of CRTs, manufacturers developed and commercially employed black matrix on the interior surface of faceplate panels of CRTs such as that described in U.S. Pat. No. 3,558,310, issued to Mayaud on Jan. 26, 1971. The matrix commonly consisted of graphite structures printed on panels whereby the structures have openings into which respective phosphor deposits are to be printed. In current entertainment CRTs, the matrix structures are vertical stripes of light-absorbing material, wherein the openings are the spaces between adjacent stripes.

In the 1970's, CRT faceplate panels were clear glass having a center transmission of about 84% and an edge transmission of about 80%. The lower edge transmission was due to the panel glass thickness being higher in the edge area than the center area. The panel thickness needed to be larger at the edge of the panel relative to the center in order to gain sufficient thermal, mechanical and vacuum strength to survive the subsequent processing of the CRT. Essentially, the required strength of the glass in the panel dictates the thickness of the panel at the center and edges and, in turn, the desired curvature of the panel dictates the required strength of the glass. In the early days, the panels had greater curvature in that the radii of the panel surfaces were relatively small. These products were referred to as 1R, where the 1R designation refers to a radius of curvature of the interior panel surface. The standard for the 1R designation is a 25V CRT having a radius of curvature on the interior of about 40.7 in., wherein "1" is a numerical coefficient and "R" is equal to 40.7 in. for 25V product. From this designation, one of skill in the art knows the approximate interior curvature of the 25V panel based on the numerical coefficient in front of the "R," e.g., 2R would imply a radius of about 81.4 in. for a 25V panel. Those skilled in the art also may recognize that the value of "R" is approximately linearly proportional to the diagonal screen dimension. Therefore, one would expect that the value of "R" for a 35V product would be about 1.4 times greater than that for the "R" of a 25V product, because the diagonal of a 35V is about 1.4 times greater than that for the 25 V product.

In the mid 1980's and early 1990's, the glass transmission was reduced to nominal values of about 52% and 42% by adding the dark tint compounds in glass melt, which exaggerated center to edge glass transmission difference to a ratio of 1.4–1.5 to 1. Additionally during this timeframe, the CRT market was directed to improved cosmetic appearance and improved viewing angles; as such, the trend was to go to panels having greater radii, such as the so-called 1.5R and 2R product. In fact, this trend continues to today, wherein CRTs are being designed and built which are virtually flat. Each change toward flatter CRTs requires the panels to have relatively even greater thickness at the edges with respect to the center to gain adequate strength. The result, however, has been an even greater reduction in the corner or edge glass transmission ratio. For example, in a true flat CRT product where the center transmission is about 52%, the corner to center transmission ratio is about 0.5:1. This is undesirable because the edge or corner brightness of the CRT becomes much lower than the center brightness. Some CRT manufacturers have tried to compensate for the difference by reducing the center matrix openings. Unfortunately, such a reduction in matrix opening produces CRTs with an undesirable reduction in overall brightness and, in some cases, the contrast ratio.

To improve the brightness and the contrast ratio and prevent a large disparity between the center and edge transmission in CRTs having flat or nearly flat panel contours, some manufacturers have gone back to the clear glass having a central transmission of 84% and applied a neutral density laminate sheet on the exterior surface of panels of CRTs. The approach is adequate for center to edge brightness and overall brightness performance of the CRT, however, it is very costly. For example, the use of such a laminate increases the manufacturing cost for a 32V CRT by about 7 Euros. Therefore, the CRT industry is in need of a more cost effective means of manufacturing CRTs with flat or nearly flat panel contours that have acceptable overall brightness performance and contrast.

SUMMARY OF THE INVENTION

The invention relates to a novel cathode-ray tube (CRT) and the cost effective method of making the same, wherein the CRT comprises an internal neutral density filter that lies between the phosphor deposits and the interior surface of the faceplate panel. The filter enhances the contrast of the CRT without compromising center to edge brightness ratio of the CRT. The invention is particularly usefull for substantially flat CRTs wherein a manufacturer requires a reduction in the transmission of the faceplate to be reduced by 25 to 75%. The filter comprises very fine particles, wherein the particles are black, gray, or a mixture of black and gray. The method of producing the novel CRT comprises the steps of preparing a suspension of well-dispersed light-absorbing particles which are 0.05 to 2 microns in an aqueous media and applying the suspension onto the interior surface of the faceplate panel prior to applying at least one phosphor deposit. The suspension may also include suitable organic and inorganic binders and dispersing and wetting agents. Suitable light-absorbing particles are carbon-containing particles, including graphite, that are stable when subjected to temperatures of 450 to 480° C. Suitable organic binders include acrylic resins and suitable inorganic binders include silica.

BRIEF DESCRIPTION OF THE DRAWINGS

The invention will now be described in greater detail, with relation to the accompanying drawings in which.

DESCRIPTION OF THE PREFERRED EMBODIMENTS

Figure 2:
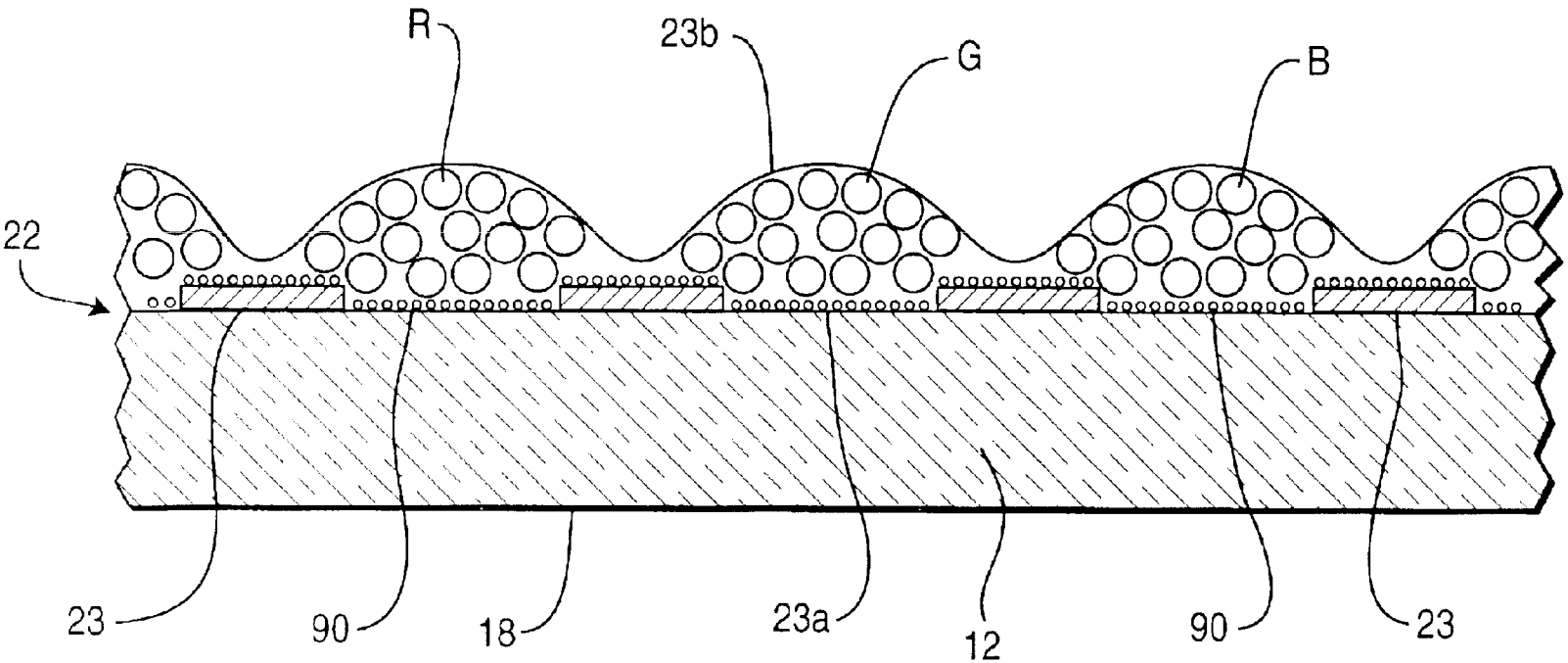
FIG. 2 is an enlarged cross-section of the CRT faceplate panel in rectangle 2 of FIG. 1, showing the screen structure of the novel CRT.

The invention relates to the use of an internal neutral density filter 90 on the interior of faceplate panel 12 of a cathode-ray tube (CRT) 10 as shown in one embodiment in FIG. 2. The invention provides a cost-effective CRT 10, and manufacture thereof, wherein the image contrast throughout a luminescent screen 22 is acceptable and the transmission character of visible light throughout the screen 22 is substantially uniform.

The embodiments according to the invention replace the need for manufacturers to use neutral density laminate sheets on the exterior surface of high transmission panels or to use darkened glass panels. The use of the embodiments, which are described below, turn out to be up to about 50 times less expensive than the use of neutral density laminate sheets with respect to providing CRTs 10 with acceptable contrast and transmission characteristics.

Further the embodiments of the invention are substantially more desirable than the use of darkened glass panels in flatter CRTs, because such panels require larger glass thickness in the corners, with respect to is the center, and, as such, the transmission of visible light in the corners is substantially lower in the corners. This causes the manufacturer to unfortunately dim the brightness in the center of such CRTs by decreasing matrix opening in order to obtain acceptable brightness uniformity.

Figure 1:
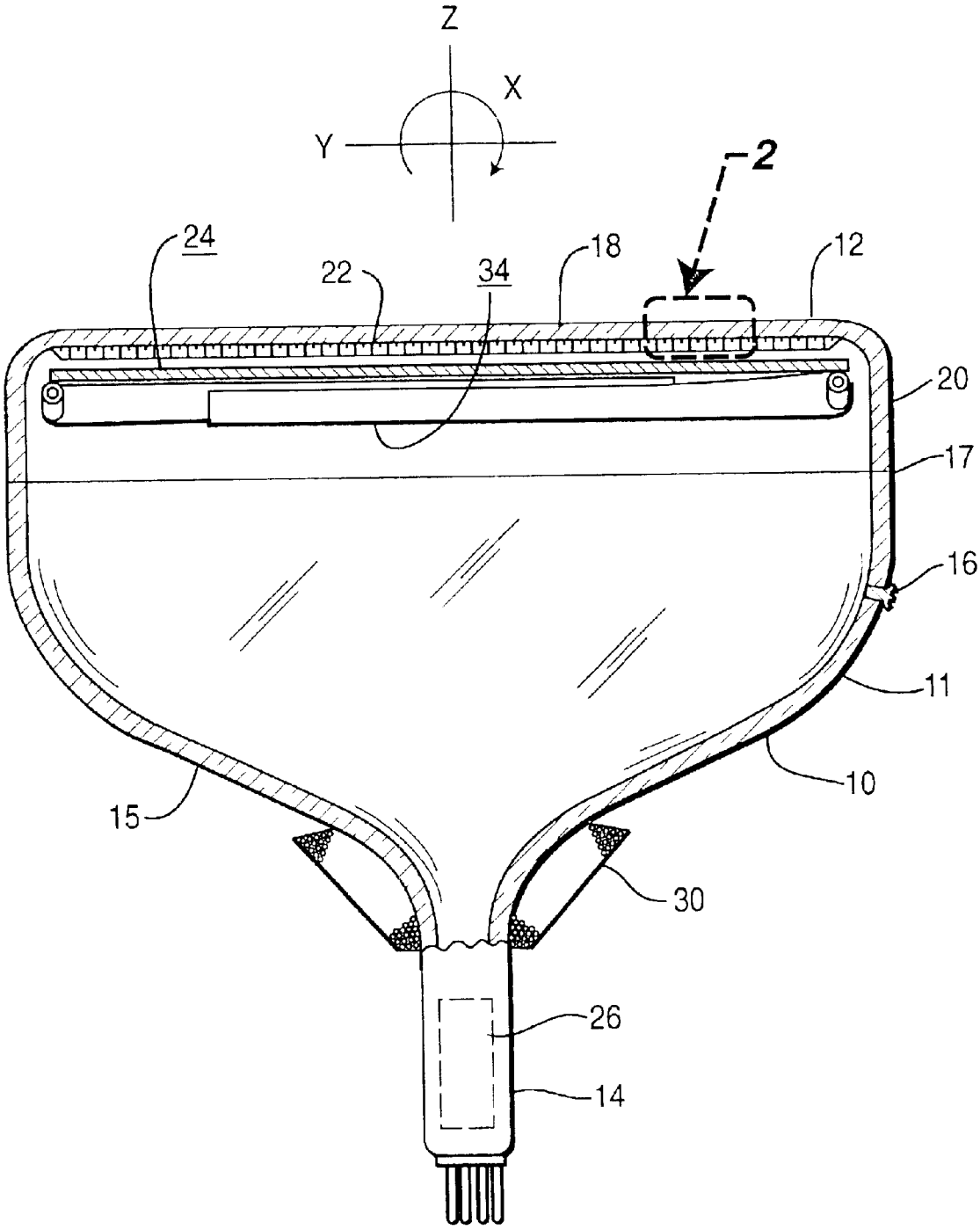
FIG. 1 is a plan view, partly in axial section, of a color cathode-ray tube (CRT) according to the present invention.

FIG. 1 shows the CRT 10 having the screen 22 which contains a novel internal neutral density filter 90 (not shown in FIG. 1) on the faceplate panel 12. In addition to the novel internal neutral density filter 90, the CRT 10 includes a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The faceplate panel 12 comprises a cylindrical viewing faceplate 18 and a peripheral sidewall 20 that is sealed to the funnel 15 by a glass frit 17. The screen 22 is a line screen with the blue-emitting phosphor B, green-emitting phosphor G, and red-emitting phosphor R arranged in triads, each triad including a phosphor line of each of the three colors separated by guardbands of a light-absorbing matrix 23, shown in FIG. 2, wherein the spaces between adjacent guardbands define openings 23*a*.

The CRT 10 also includes a multi-apertured shadow mask 24 supported on frame 34. The mask is removably mounted within the faceplate panel 12, in predetermined spaced relation to the screen 22. An electron gun 26, shown schematically by the dashed lines, is also present. The gun 26 is centrally mounted within the neck 14 to generate and direct three inline electron beams (shown in FIG. 1) along convergent paths through the mask 24 to the screen 22. The electron gun 26 may be any suitable gun known in the art.

The CRT 10 is also designed to be used with an external magnetic deflection yoke 30 shown in the neighborhood of the funnel-to-neck junction. When activated, the yoke 30 subjects the three electron beams to magnetic fields that cause the beams to scan a horizontal and vertical rectangular raster over the screen assembly 22. As is known in the art, an aluminum layer 23*b* overlies the screen 22 and provides an electrical contact thereto, as well as a reflective surface to direct light, emitted by the phosphors, outwardly through the viewing faceplate 18.

The invention provides a CRT 10 having the novel screen 22. FIG. 2 shows one example, where the screen 22, in addition to having the phosphor lines and the matrix 23, also includes small particles of the internal neutral density filter 90 which lie between the phosphor particles and the interior surface of the panel. The advantage to having such structure is that the actual phosphorescent light emitted by the phosphor as it is bombarded by incident electron beam is only filtered once by the neutral density filter 90 while the ambient light that enters the panel is essentially filtered twice, i.e. first filtered by the internal neutral density filter 90 as it enters tube and then filtered a second time by the neutral density filter 90 when the ambient light tries to exit the tube after it is reflected or scattered by the phosphor and the aluminum layer 23*b*. This is the same effect that manufacturers attempt to achieve when neutral density laminate sheets are applied on exterior surfaces of clear glass panels or when darkened glass panels are used.

The process for making the CRT 10 first involves making a suspension of the small particles, wherein the small particles are dark inorganic materials. The suspension is aqueous-based and can contain appropriate binders and surfactants. The suspension can be tailored by appropriately varying the solid contents of dark inorganic materials in suspension and the application cycle to control (1) the effective transmission, (2) the tube face reflectivity of the glass to some overall desired level, and (3) to some limited degree, the center to edge effective glass transmission ratio to a desired level. The tube face reflectivity is the measure of that portion of the ambient light that exits the tube after the ambient light entered the tube with the specular components from either the panel surface not included in the measurement.

The preferred embodiments involve preparing an aqueous-based suspension comprising about 0.05 to 2 micron size carbon or graphite particles with acrylic organic and silica inorganic binders and appropriate surfactants for dispersion, emulsification and wetting characteristics. The suspension is applied to a dry rotating panel 12 which has the matrix 23 already applied. The suspension is then applied by limp stream method. The coating uniformity is achieved by subsequently spinning the panel at higher rotational speed for 5 to 15 seconds to achieve desired center to edge carbon solids distribution. The internal neutral density filter 90 is dried at a slower rotational speed for 60 seconds. The binders in the suspension help to bind the carbon neutral density filter 90 to the panel 12 and allow the adequate binding to withstand the subsequent phosphor and film application process, hence, resulting in no significant change in filter density. Controlling the amount of carbon solids in the suspension controls the overall reduction in effective transmission and overall incident light tube face reflectivity of the screen 22 in the openings 23*b*.

A requirement of the particles designated for the internal neutral density filter is that they are stable when subjected to temperatures of 450 to 480° C. The reason is that the internal neutral density filter will be subjected to temperatures around 450° C. during the screen bake cycle and frit seal cycle during CRT manufacturing.

Various embodiments or examples of the invention are as follows:

EXAMPLE 1

An aqueous-based suspension is prepared by first mixing 9335 g of deionzed water at room temperature with 455 g of Acheson Electrodag 1530 stock formulation at 11% graphite solids with the ingredients under a continuous high-speed agitation at room temperature for 20 min. Next, 140 g of 5% Tween 20 surfactant and 70 g of Triton X-100 surfactant are added while the mixture is mixed at a very low speed of agitation. The Acheson Electrodag 1530 stock formulation contain an organic acrylic binder and an inorganic silica binder. If desired, additional silica such as Kasil, Ludox, etc. can be added for more adhesion to the glass surface with the approximate ratio of silica to graphite being about 0.05:1. Organic binders in acrylic or latex family can also be added to increase adhesion or viscosity of the filter solution at approximate ratio of the acrylic to graphite of about 0.1:1. Surfactants with good hydrophilic, dispersing, emulsifying, and wetting character can be used and include Triton X-45, NP-40 and Tamol 731. Other surfactants include Tween 20 and Triton X-100. The graphite solid concentration is about 0.5% by weight.

After mixing, the suspension is filtered through a 50 micron screen and put into dispense pot with a ⅜" ID Tygon dispense hose with shut off valves. A panel 12 containing matrix 23 is then placed on a static machine at 10 degrees passed vertical position and rotated at 20 RPM as the suspension is limp steamed onto the panel 12 for 6 to 7 seconds. The panel 12 is then spun at 100 RPM for 10 seconds to evenly distribute the internal neutral density filter 90 across the panel 12. The filter 90 is then dried with radiant heat for 60 seconds and taken off the machine. The resulting transmission data of the panel after the application of the internal neutral density filter as described above when graphite particles in suspension were at a 0.5% by weight were as follows:

| | |
|---|---|
| Reduction in center area transmission: | 35% |
| Reduction in edge (corner) area transmission: | 35% |

EXAMPLE 2

The method is the same as that in EXAMPLE 1, except the graphite solids are raised from 0.5% to 0.65%. The resulting transmission data of the panel 12 after the application of the internal neutral density filter 90 as described above were as follows:

| | |
|---|---|
| Reduction in center area transmission: | 46% |
| Reduction in edge (corner) area transmission: | 46% |

EXAMPLE 3

The method is the same as that in EXAMPLE 1, except the graphite solids is raised to 0.75%. The resulting transmission data of the panel 12 after the application of the internal neutral density filter 90 as described above were as follows:

| | |
|---|---|
| Reduction in center area transmission: | 54% |
| Reduction in edge (corner) area transmission: | 53% |

EXAMPLE 4

The method is the same as that in EXAMPLE 1, except following dispense of the neutral density filter solution, the panel 12 is spun at 120 RPM for 6 seconds. The resulting transmission data of the panel 12 after the application of the internal neutral density filter 90 as described above were as follows:

| | |
|---|---|
| Reduction in center area transmission: | 40% |
| Reduction in edge (corner area transmission: | 37% |

EXAMPLE 5

The method is the same as that in EXAMPLE 1, except following dispense of the neutral density filter solution, the panel 12 is spun at 140 RPM for 14 seconds. The resulting transmission data of the panel 12 after the application of the internal neutral density filter 90 as described above were as follows:

| | |
|---|---|
| Reduction in center area transmission: | 30% |
| Reduction in edge (corner) area transmission: | 32% |

The table below shows a list of suitable dark neutral density materials. However, the scope of the invention is not limited to these materials.

| Material Name | Manufacturer | Binders in Material | Particle Size |
|---|---|---|---|
| Electrodag 1530 | Acheson Colloids | Acrylic & Silica | 0.5 micron |
| Hitasol 542 | Hitachi chemicals | Acrylic & Silica | 0.4 micron |
| Hitasol 66 M | Hitachi Chemicals | Acrylic and Silica | 0.25 micron |
| Gray Glass powder | TV Glass Makers | NONE(to be added) | 1 micron |

In general, darker or blacker filter material is preferred for less reflectivity. Also, smaller particle size material with a narrow distribution in size is preferred for the application and transparency of the neutral density filtering. The most desirable particle size range is 0.2 microns to 0.3 microns.

While the above provides a detailed description of the invention and the best mode of practicing the invention, the invention is not limited solely to the description and examples. There are modifications or functional equivalent that can become apparent to one skilled in the art in view of the description that are also within the scope of the invention. Other examples, inter alia, include the application of the invention in dot screen structures, in so-called 'sunshine' screen structures and in cases where the filter 90 is applied before the matrix 23.

What is claimed is:

1. A CRT comprising a panel having an interior surface, said surface having neutral density filter particles having dimensions in the range of about of 0.05 microns to 2 microns, thereon, said neutral density filter particles reduces the transmission of said panel by 25 to 75%, and at least one phosphor deposit being on top of said neutral density filter particles, whereby the neutral density filter increases the contrast of the CRT.

2. The CRT in claim 1, wherein said panel has an exterior surface that is substantially flat.

3. The CRT in claim 1, wherein said neutral density filter particles are of essentially of one type.

4. The CRT in claim 1, wherein said panel is clear glass.

* * * * *